US007114620B2

(12) United States Patent
Anibas

(10) Patent No.: US 7,114,620 B2
(45) Date of Patent: Oct. 3, 2006

(54) MULTI-DECK SCREENING MACHINE

(75) Inventor: Franz Anibas, Gleisdorf (AT)

(73) Assignee: Binder + Co. AG, Gleisdorf (AT)

( * ) Notice: Subject to any disclaimer, the term of this patent is extended or adjusted under 35 U.S.C. 154(b) by 31 days.

(21) Appl. No.: 10/652,548

(22) Filed: Aug. 29, 2003

(65) Prior Publication Data

US 2004/0050757 A1 Mar. 18, 2004

(30) Foreign Application Priority Data

Sep. 12, 2002 (AT) ..... GM606/2002

(51) Int. Cl.
*B07B 1/28* (2006.01)

(52) U.S. Cl. ..... 209/319; 209/326

(58) Field of Classification Search ..... 209/315, 209/319, 326, 399, 403, 405, 408, 409, 412; 411/119

See application file for complete search history.

(56) References Cited

U.S. PATENT DOCUMENTS

| | | | | |
|---|---|---|---|---|
| 177,252 | A * | 5/1876 | Johnson | 209/330 |
| 385,427 | A * | 7/1888 | Pugh | 209/319 |
| 1,923,229 | A * | 8/1933 | Robins | 209/326 |
| 3,378,142 | A | 4/1968 | Wehner | |
| 3,633,745 | A | 1/1972 | Wehner | |
| 3,647,068 | A * | 3/1972 | Wehner | 209/310 |
| 4,188,288 | A * | 2/1980 | Wehner | 209/310 |
| 4,504,386 | A * | 3/1985 | Dyren et al. | 209/254 |
| 4,581,132 | A | 4/1986 | Fritz et al. | |
| 4,819,810 | A * | 4/1989 | Hoppe | 209/315 |
| 4,836,385 | A | 6/1989 | Slesarenko et al. | |
| 5,341,939 | A * | 8/1994 | Aitchison et al. | 209/319 |
| 6,666,336 | B1 * | 12/2003 | Kreft | 209/365.3 |

FOREIGN PATENT DOCUMENTS

| | | |
|---|---|---|
| AT | 379 088 | 11/1985 |
| DE | 1204920 | 11/1965 |
| DE | 1275339 | 8/1968 |
| DE | 2216130 | 10/1973 |
| DE | 24 29 733 | 1/1976 |
| DE | 38 26 996 | 2/1990 |
| WO | WO92/00148 | 1/1992 |

* cited by examiner

*Primary Examiner*—Joseph Rodriguez
(74) *Attorney, Agent, or Firm*—Collard & Roe, P.C.

(57) ABSTRACT

A screening machine comprises a screen frame elastically supported on a fixed base and comprising screen cheeks and screen frame crossbeams which connect the screen cheeks, a drive for oscillating the screen frame, and a swing frame elastically coupled to the screen frame. The swing frame comprises thrust rods elastically coupled to the screen cheeks, fastening components projecting from the thrust rods and extending parallel to the screen cheeks, swing frame crossbeams arranged on each fastening component which connect the thrust rods, and at least two screening surfaces formed by screening mats extending substantially parallel to each other, the screening mats being alternately compressed and stretched in sections by being alternatingly fastened to the swing frame crossbeams and the screen frame crossbeams.

8 Claims, 5 Drawing Sheets

MULTI-DECK SCREENING MACHINE

BACKGROUND OF THE INVENTION

1. Field of the Invention

The present invention relates to a screening machine comprising a screen frame which comprises screen cheeks, is made to oscillate by means of a drive and is supported in an elastic manner on a fixed base, and a swing frame which is elastically coupled thereto.

2. Description of the Prior Art

Screening machines with a screening surface made up of screening mats are known from AT 379.088 for example. The movement of the screening mats usually occurs by a amplitude-excited oscillation system which is held on a moved screen frame. The screening mats forming the screening surface are fastened alternatingly on the screen frame and the oscillation system, so that there will be a compression or stretching of the screening mats through the relative movement of the two systems with respect to each other.

In order to obtain several fractions for example it is also known to provide two such amplitude-excited oscillation systems independent from each other in an oscillating screen frame.

This leads to the disadvantage that such a two-deck screening machine is very high with respect to its design and therefore cannot be used everywhere. Moreover, the constructional efforts for two oscillation systems are very high and an adjustment needs to be made for each oscillation system separately. The construction of multi-deck (>2) oscillation systems is therefore out of the question in view of these configurations.

SUMMARY OF THE INVENTION

It is therefore the object of the present invention to provide a screening machine which avoids these disadvantages, is of a compact design and still offers the advantages of a more selective fractioning of two-deck screening machine.

This is achieved in accordance with the invention with a screening machine comprising a screen frame elastically supported on a fixed base and comprising screen cheeks and screen frame crossbeams which connect the screen cheeks, a drive for oscillating the screen frame, and a swing frame elastically coupled to the screen frame. The swing frame comprises thrust rods elastically coupled to the screen cheeks, fastening components projecting from the thrust rods and extending parallel to the screen cheeks, swing frame crossbeams arranged on each fastening component which connect the thrust rods, and at least two screening surfaces formed by screening mats extending substantially parallel to each other, the screening mats being alternately compressed and stretched in sections by being alternatingly fastened to the swing frame crossbeams and the screen frame crossbeams.

It is thus merely necessary to arrange a single oscillation system on the screen frame in which the screening mats are fixed in addition to the fixing on the screen frame. It is also possible to provide several screen surfaces on one and the same oscillation system.

The entire screening machine is thus provided with a substantially lower design despite the fact that several screen surfaces which are formed by screening mats are available. The application as a mobile screening unit is thus also possible. The configuration of two or more screening surfaces can thus be realized easily.

If the thrust rods extend at an angle, particularly at an angle decreasing in the conveying direction inclined to the fixed face, further conveyance of the material to be screened in the direction of inclination is allowed.

The fixing points of the swing frame crossbeams to the respective fastening component may lie in a plane extending in a normal manner to the longitudinal axis of the thrust rods. Alternatively, they may lie in at least two planes extending in a normal manner to the longitudinal axis of the thrust rods.

The different geometrical arrangement of the fixing points of the screen frame crossbeams on the fastening components is made on the basis of experimental values with respect to the respective material to be screened and leads to an increase in the screening effect.

The swing frame crossbeams may be arranged on each fastening component on either side of the respective thrust rods. This achieves the best screening effect in practice. The screen frame may be supported in an elastic manner on the solid base by means of springs.

BRIEF DESCRIPTION OF THE DRAWING

A detailed description of the invention on the basis of an embodiment is provided below by reference to the enclosed drawings, wherein.

DETAILED DESCRIPTION OF PREFERRED EMBODIMENTS

Figure 1:
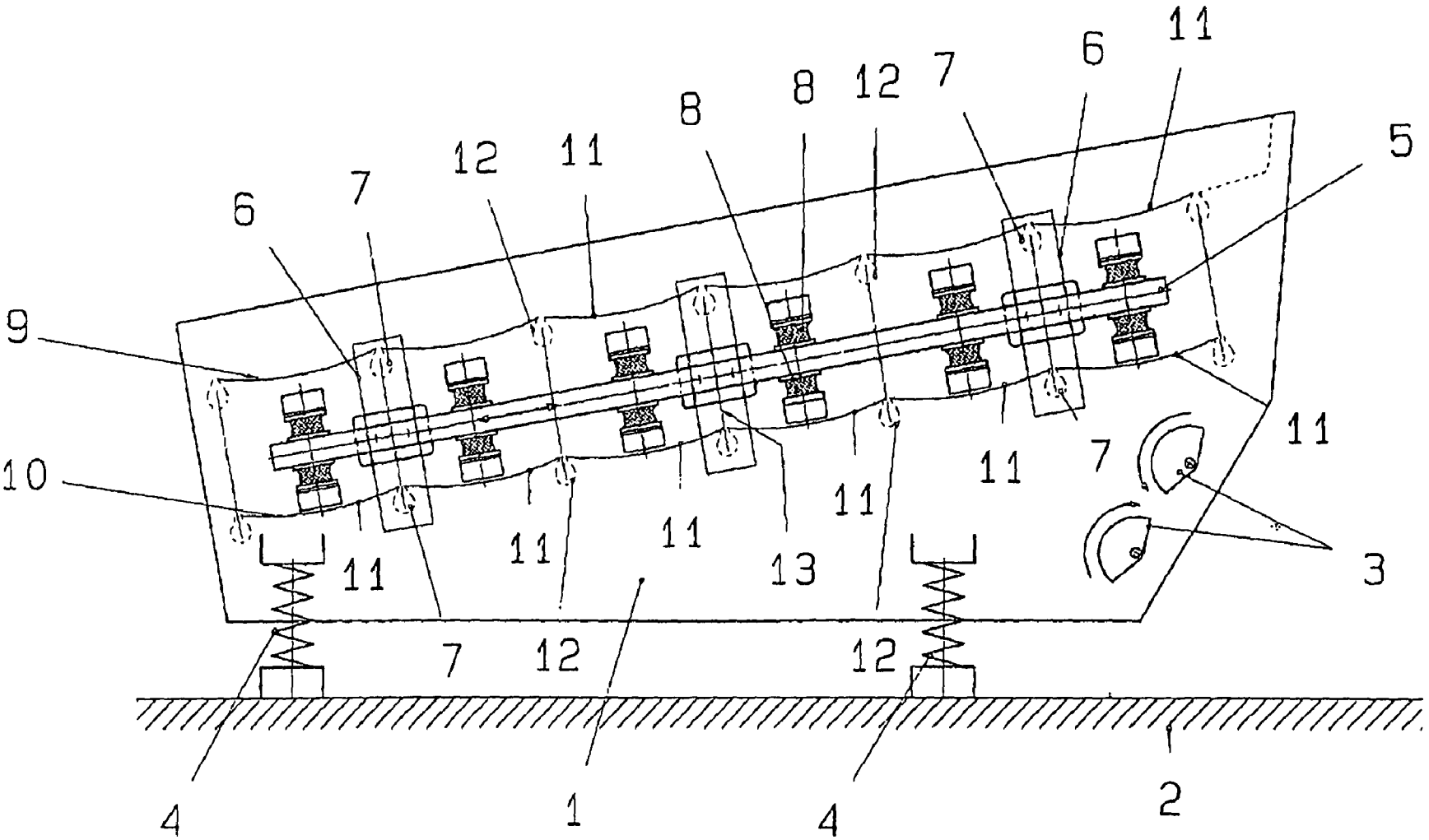
FIG. 1 shows a schematic side view of a screening apparatus in accordance with the invention.
Figure 2:
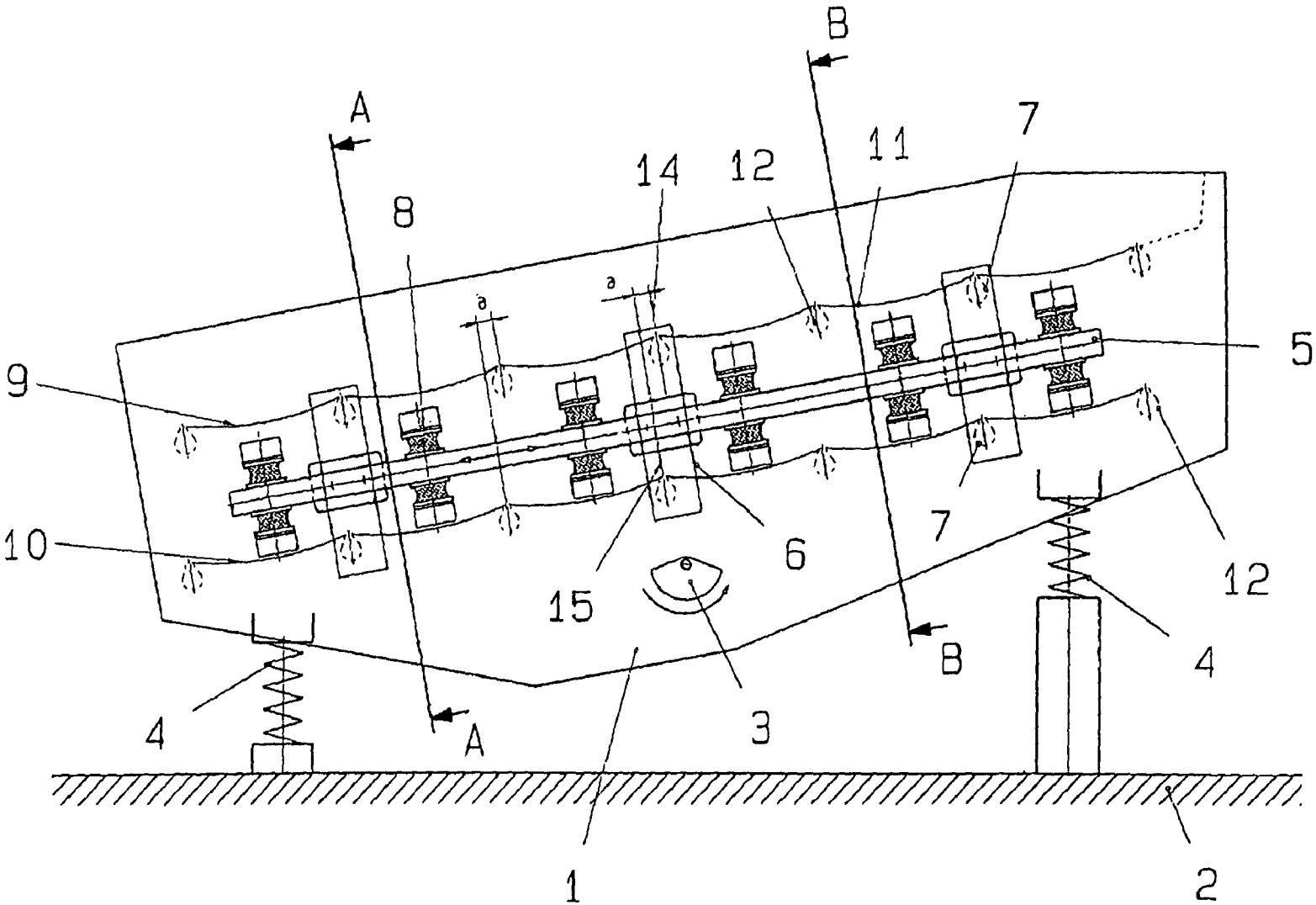
FIG. 2 shows a schematic side view of an alternative embodiment of a screening apparatus in accordance with the invention.
Figure 4:
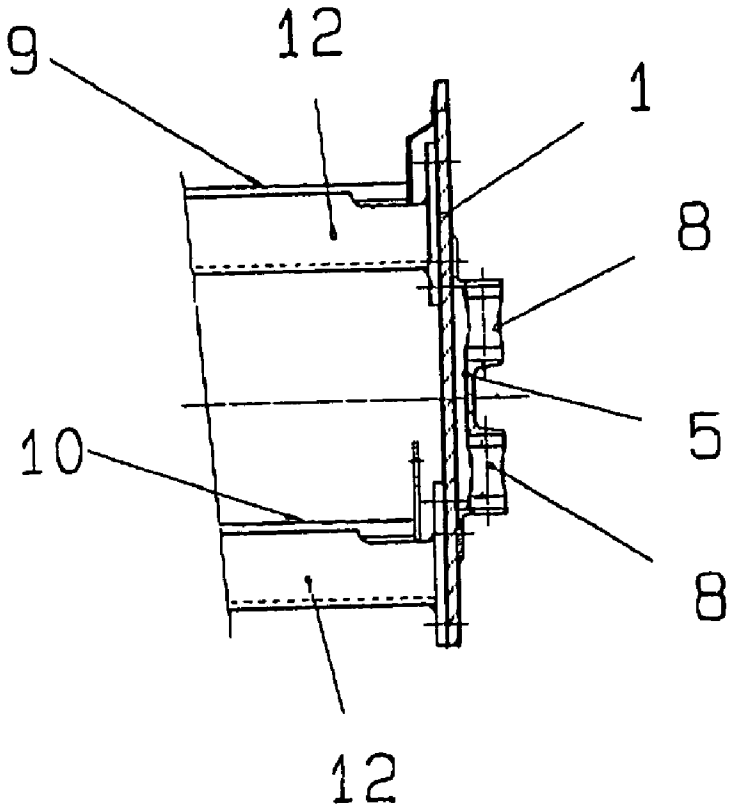
FIG. 4 shows a sectional view along line BB of FIG. 2.
Figure 3:
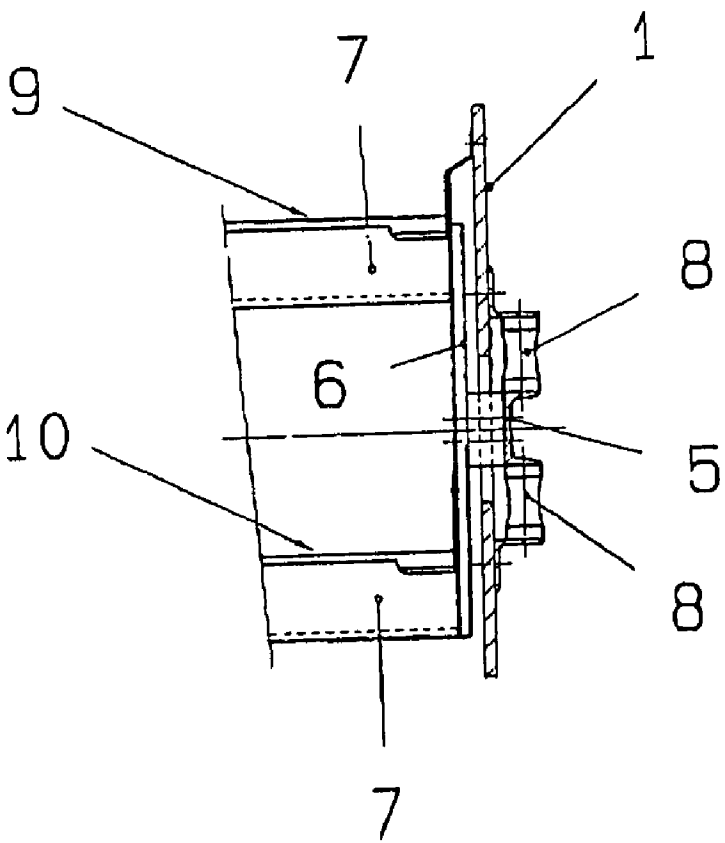
FIG. 3 shows a sectional view along line AA of FIG. 2.
Figure 5:
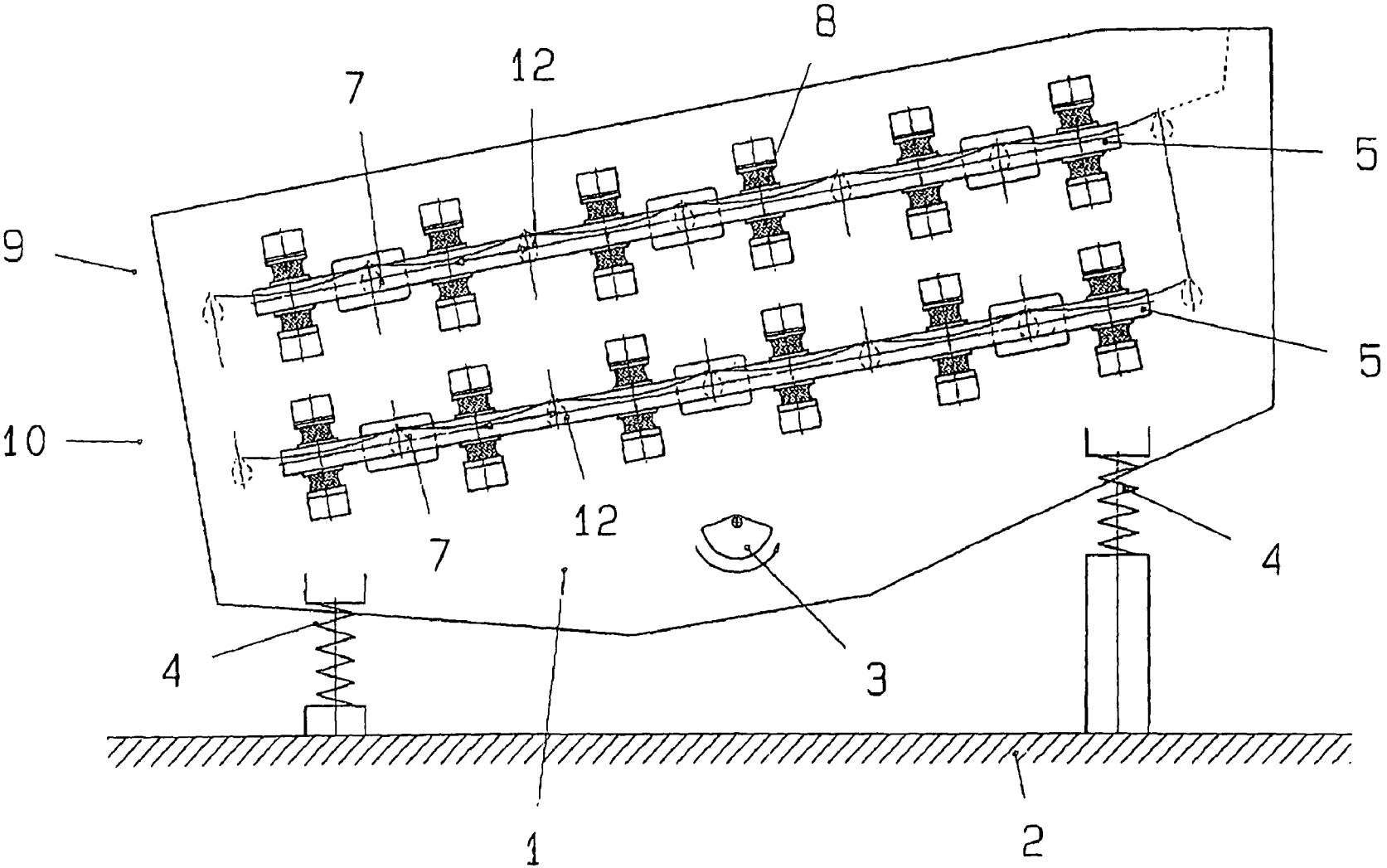
FIG. 5 shows a schematic side view of a multi-deck screening machine according to the state of the art.
Figure 7:
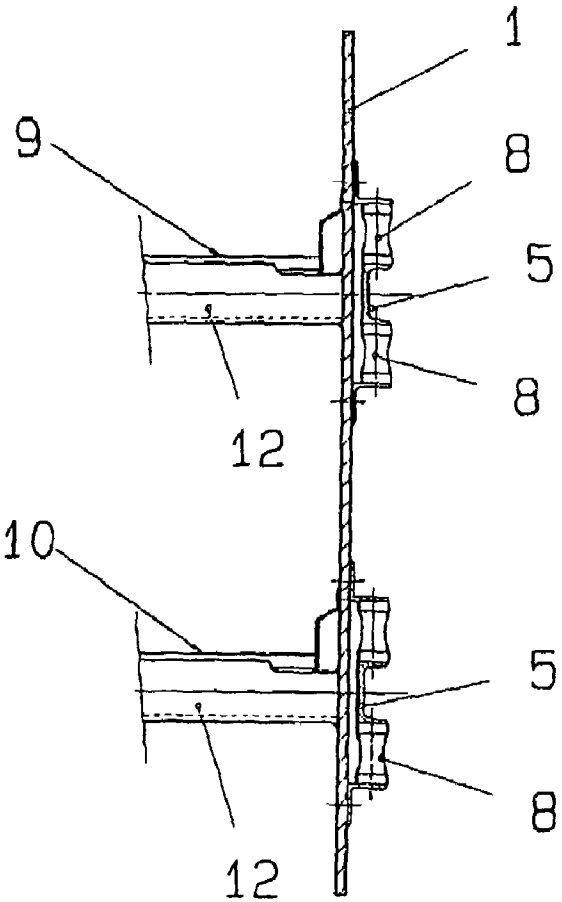
FIG. 7 shows a side view along line DD of FIG. 5.
Figure 6:
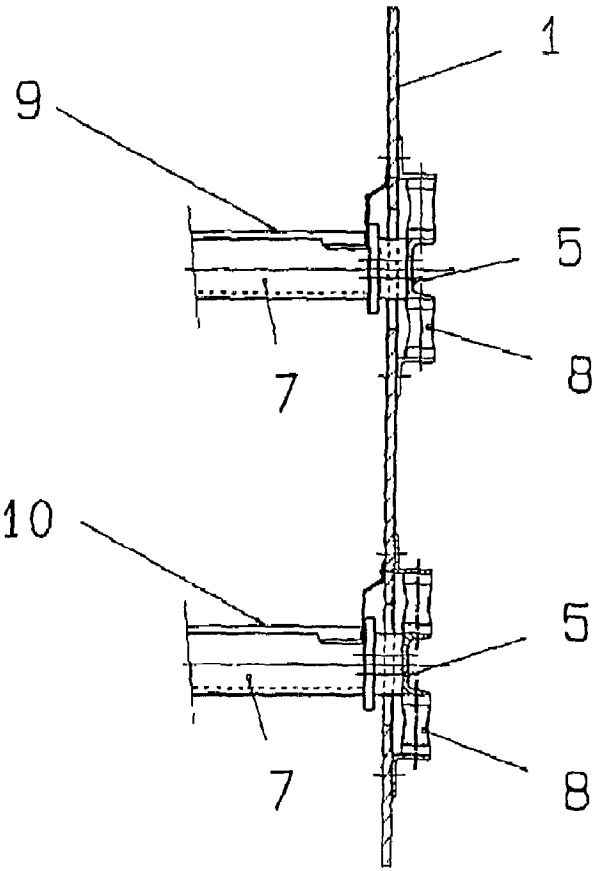
FIG. 6 shows a side view along line CC of FIG. 5.

As is shown in FIG. 1, a two- or multi-deck screening machine in accordance with the invention consists of a screen frame 1 which comprises screen cheeks and is supported on springs 4 relative to a fixed base 2 and of a drive 3 which makes the screen frame 1 oscillate. In the present case it is configured as a double unbalance-type drive with two oppositely rotating unbalance weights, as a result of which a linear excitation oscillation is produced. Principally, however, all kinds of unbalance drives can be used. FIG. 2 shows the use of a single unbalance drive 3 for example which makes the screen frame oscillate in a circulatory fashion.

An oscillation system is arranged on the screen frame 1 which forms a swing frame, which oscillation system consists of thrust rods 5 which are held on the screen cheeks of the screen frame 1 via preferably elastic rubber blocks 8 as well as fastening components 6 which are arranged on the same. The fastening components 6 extend in a substantially rectangular manner to the longitudinal axis of the thrust rods 5 and parallel to the screen cheeks of the screen frame 1. Two swing frame crossbeams 7 are fastened below each other to the fastening components 6. The swing frame crossbeams mutually connected oppositely disposed fastening components 6.

The screen cheeks of the screen frame 1 are mutually connected via screen frame crossbeams 12.

The screen surfaces 9, 10 are made up of individual screening mats 11. Every screening mat 11 is fastened in an alternating manner to a swing frame crossbeam 7 and a screen frame crossbeam 12.

The fastening of the swing frame crossbeam 7 and the screen frame crossbeam 12 of a screening surface 9, 10 occurs substantially along a straight line, so that a continuous, substantially straight screening surface 9, 10 is obtained. Any deviations from a straight screening surface 9, 10 are obtained through the system due to a certain sagging of the individual screening mats. This is necessary in order to allow the compression and stretching of the screening mats 11.

The screening apparatus works in the following manner: The swing frame is also made to oscillate in an amplitude-excited fashion by the screen frame 1 which is made to oscillate by the unbalance drive 3. As a result of the elastic bearing of the thrust rods 5 of the swing frame on the screen frame 1, an oscillation of the swing frame is obtained which is offset to the fundamental oscillation of the screen frame 1. As a result of the alternating fastening of the screening mats 11 on the screen frame 1 and on the swing frame (fastening components 6), the screening mats 11 are alternatingly compressed and stretched. This on the other hand produces an optimal screening effect.

The screening apparatus in accordance with the invention is especially characterized in that it is of a two- or multi-deck arrangement and still merely one oscillation system is present. This leads to the advantage that the entire apparatus is provided with a low overall height, thus allowing mobile applications. Moreover, the adjustment of the oscillation systems is substantially easier because it is merely necessary to adjust one system. In the case of a multi-deck arrangement it is necessary to arrange several respective swing frame crossbeams 7 on the respective fastening components 6.

For reasons of clarity, the present embodiment only includes two screening decks, i.e. screening surfaces 9, 10. It is obvious, however, that a random number of screening surfaces can be provided in an arrangement above one another.

In order to further increase the screening output, it is provided that the fixing of the individual oscillation system crossbeams 7 which are arranged on a fastening component 6 is made in at least two planes 14, 15 which extend in a normal manner to the longitudinal axis of the thrust rods 5. An offset "a" is obtained which is based on the batch material supplied to the screening machine and the separating cut sizes.

It is also possible to provide the fixing of the individual oscillation system crossbeams 7 which are arranged on a fastening component 6 in a single plane (13) which extends in a normal manner to the longitudinal axis of the thrust rods (5).

The screen frame crossbeams 12 of the individual screening surfaces 9, 10 can either each be arranged in a plane which is normal to the longitudinal axis of the thrust rods 5 or with an offset "a" (see FIG. 2).

The present oscillation system can also be provided with a banana arrangement with a continuously decreasing screen deck inclination.

The invention claimed is:

1. A screening machine comprising:

a screen frame elastically supported on a fixed base and comprising a plurality of screen cheeks and screen frame crossbeams which are rigidly connected to said plurality of screen cheeks, a drive coupled to said screen frame for oscillating said screen frame;

a swing frame elastically coupled to said screen frame, said swing frame comprising:

a plurality of rubber blocks, a plurality of thrust rods elastically coupled to the screen cheeks via said plurality of rubber blocks, a plurality of fastening components rigidly fixed to and projecting from both sides of each of said plurality of thrust rods and extending parallel to said plurality of screen cheeks, a plurality of swing frame crossbeams rigidly fixed to each fastening component which connect said plurality of thrust rods, wherein at least one swing frame cross beam is fixed on each side of said thrust rods; and at least two screening surfaces formed by screening mats extending substantially parallel to each other, said screening mats being alternately compressed and stretched in sections wherein each of said screening mats are fastened to at least one swing frame crossbeam, which is moveably supported with respect to said screen frame, and wherein said screening mats are fastened to at least one screen frame crossbeam being rigidly fixed to said screen frame.

2. The screening machine of claim 1 wherein said plurality of thrust rods extend at an angle relative to the fixed base.

3. The screening machine of claim 2, wherein the angle decreases in a conveying direction.

4. The screening machine of claim 1 wherein said plurality of fastening components project perpendicularly on both sides from the thrust rods.

5. The screening machine of claim 1 wherein fixing points of the swing frame crossbeams to respective ones of the fastening components lie in a plane extending perpendicularly to a longitudinal axis of the thrust rods.

6. The screening machine of claim 1 wherein fixing points of the swing frame crossbeams to respective ones of the fastening components lie in at least two planes extending perpendicularly to a longitudinal axis of the thrust rods.

7. The screening machine of claim 1, wherein at least one of said swing frame crossbeams is arranged on each fastening component on either side of a respective one of the thrust rods.

8. The screening machine of claim 1, further comprising springs for elastically supporting the screen frame on the fixed base.

* * * * *